US006818367B2

(12) United States Patent
Priebe et al.

(10) Patent No.: US 6,818,367 B2
(45) Date of Patent: Nov. 16, 2004

(54) SUPPORT WITH REDUCED OPTICAL BRIGHTENER MIGRATION

(75) Inventors: Elizabeth K. Priebe, Rochester, NY (US); William A. Mruk, Rochester, NY (US); James C. Pirchner, Fairport, NY (US); Suresh Sunderrajan, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/413,933

(22) Filed: Apr. 15, 2003

(65) Prior Publication Data

US 2004/0209180 A1 Oct. 21, 2004

(51) Int. Cl.[7] ..... G03C 1/795; G03C 1/815; G03G 5/10; B41J 2/01

(52) U.S. Cl. ..... 430/60; 430/201; 430/536; 430/933; 347/105; 428/32.17; 428/32.19; 428/32.21; 428/32.22; 428/32.39

(58) Field of Search ..... 430/60, 201, 536, 430/933; 347/105; 428/32.17, 32.19, 32.21, 32.22, 32.39

(56) References Cited

U.S. PATENT DOCUMENTS

| | | | | |
|---|---|---|---|---|
| 3,260,715 A | | 7/1966 | Saunders | |
| 3,366,575 A | | 1/1968 | Ono et al. | |
| 3,411,908 A | | 11/1968 | Crawford et al. | |
| 3,449,257 A | | 6/1969 | Tuite et al. | |
| 3,501,298 A | | 3/1970 | Crawford | |
| 4,352,861 A | | 10/1982 | von Meer et al. | |
| 4,794,071 A | | 12/1988 | Tomko et al. | |
| 4,859,539 A | | 8/1989 | Tomko et al. | |
| 5,198,330 A | | 3/1993 | Martic et al. | |
| 5,340,854 A | | 8/1994 | Martic et al. | |
| 5,476,708 A | | 12/1995 | Reed et al. | |
| 5,817,448 A | * | 10/1998 | Hayashi et al. | 430/933 |
| 6,312,822 B1 | | 11/2001 | Irick, Jr. et al. | |
| 6,447,976 B1 | * | 9/2002 | Dontula et al. | 430/201 |
| 6,492,032 B1 | | 12/2002 | Daily et al. | |
| 6,335,102 B1 | | 2/2003 | Morita et al. | |
| 6,521,399 B1 | | 2/2003 | Bourdelais et al. | |
| 2002/0136912 A1 | | 9/2002 | Irick, Jr. | |

FOREIGN PATENT DOCUMENTS

WO 01/36533 A1 5/2001

* cited by examiner

*Primary Examiner*—Richard L. Schilling
(74) *Attorney, Agent, or Firm*—Lynne M. Blank

(57) ABSTRACT

The invention relates to an imaging element comprising an imaging layer and a support, wherein the support comprises a base material having thereon at least two polyolefin layers, wherein the uppermost layer of the at least two polyolefin layers comprises a mixture of optical brighteners comprising a Compound A having the following formula:

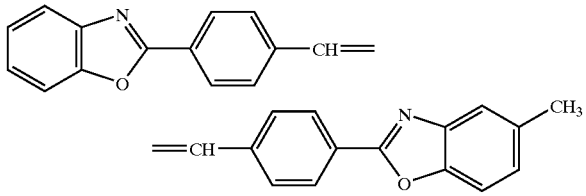

a Compound B having the following formula:

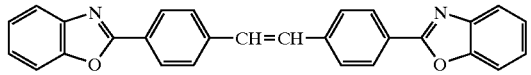

and a Compound C having the following formula:

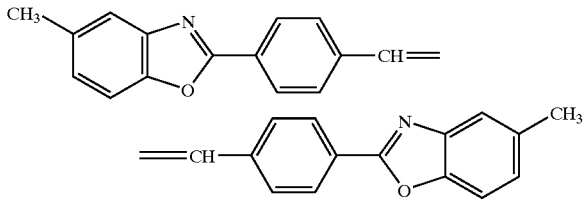

wherein the layers below the uppermost layer of the at least two polyolefin layers comprise migratory optical brightener; and wherein the imaging layer is on the same side of the base material as the at least two polyolefin layers. The inventive support unexpectedly minimizes exudation of the brightener at the polyolefin surface and provides excellent absorption/emission characteristics, brightening power and heat to meet the critical requirements of the photographic field.

37 Claims, No Drawings

SUPPORT WITH REDUCED OPTICAL BRIGHTENER MIGRATION

FIELD OF THE INVENTION

This invention relates to photographic supports and elements, and more particularly, to photographic supports and elements comprising a paper base material having thereon at least two polyolefin coatings containing optical brightener.

BACKGROUND OF THE INVENTION

Photographic supports and elements comprising a paper base material with polyolefin coatings containing white pigment and optical brightener are a valuable class of photographic materials. Such supports are particularly useful in the preparation of photographic elements such as color prints because they exhibit good brightness and excellent dimensional stability and are highly resistant to the action of aqueous acid and alkaline photographic processing solutions. The polyolefin coating on the base provides a very smooth surface, which is desirable when thin layers, such as silver halide emulsion layers, are to be coated on the base. U.S. Pat. No. 3,411,908 describes such a support which has achieved widespread commercial acceptance.

The purpose of the optical brightener is to make the white areas of the support appear even brighter. The optical brightener fluoresces upon irradiation with UV (ultraviolet) light, emitting visible light, usually bluish in hue, thus enhancing the brightness of the support. Optical brighteners for use in photographic print materials must absorb UV light, especially in the region from 360 to 420 nm, and reemit such light to enhance the brightness of the print. The optical brightener must also be stable to the temperatures as high as from 310 C to 330 C, which are used in incorporating the optical brightener into the polyolefin and in extruding the polyolefin onto the paper base material.

Moreover, the optical brightener must be non-migrating so that it remains in the polyolefin coating and does not exude as a surface film on the polyolefin. Such exudation may not only give rise to a nonuniform brightness of the reflection surface of the support, but also readily transfers to any other surface contacted with it. For example, brightener may be transferred nonuniformly to the back side of the adjacent layer of support when wound in roll form, adversely affecting subsequent coating and finishing operations and, in consequence, the quality and performance of the final element.

U.S. Pat. No. 3,501,298 describes a photographic element having a support comprising a paper base having thereon a polyolefin coating, which contains titanium dioxide and bis(alkylbenzoxazolyl)thiophenes. U.S. Pat. No. 3,449,257 relates to compositions comprising hydrophobic polymers and non-migrating optical brighteners and to paper supports coated with such compositions. The non-migrating optical brighteners are 2,5-bis(benzoxazolyl)thiophenes. U.S. Pat. No. 3,260,715 discloses fluorescent bis(benzoxazolyl) stilbenes, such as 4,4'-bis(benzoxazol-2-yl)stilbene, which are useful as fluorescent brightening agents for textile fibers, papers, resins and photographic color print materials. U.S. Pat. Nos. 4,794,071 and 4,859,539 disclose photographic supports comprised of a paper base having thereon a polyolefin coating containing a white pigment and a mixture of fluorescent bis(benzooxazoyl)-stilbenes. However, obtaining the desired mixture of the fluorescent stilbenes is difficult and very costly. U.S. Pat. No. 5,198,330 and U.S. Pat. No. 5,340,854 disclose improved photographic supports, especially useful for color prints, comprised of a paper base material having thereon a polyolefin coating containing a white pigment and an optical brightener, such as a mixture comprising inclusion compounds of equimolar amounts of a fluorescent bis(benzoxazolyl) stilbene and a cyclodextrin.

However, these and other prior art brighteners do not exhibit the combination of absorption/emission characteristics and brightening power, heat stability, and resistance to brightener exudation to the levels desired for photographic supports and elements. Thus, there remains a need for a photographic element comprising an optically brightened support, such support having improved resistance to brightener exudation and wherein the brightener exhibits excellent absorption/emission characteristics, brightening power and heat stability.

PROBLEM TO BE SOLVED

The problem to be solved is reducing the exudation of optical brighteners onto the support surface to allow use of more easily manufacturable/less expensive stilbenes.

SUMMARY OF THE INVENTION

The present invention relates to an imaging element comprising an imaging layer and a support, wherein said support comprises a base material having thereon at least two polyolefin layers, wherein the uppermost layer of the at least two polyolefin layers comprises a mixture of non-migratory optical brighteners, the mixture of optical brighteners comprising 2-[4-[2-[4-(2-benzoxazolyl)phenyl]ethenyl]phenyl]-5-methylbenzoxazole, hereinafter referred to as Compound A, having the following formula:

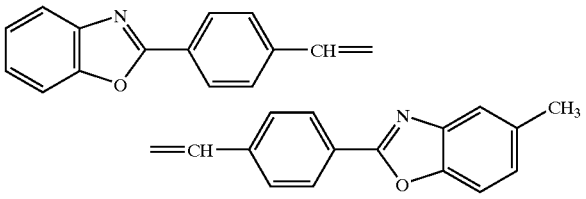

a 2,2'-(1,2-ethenediyldi-4,1-phenylene)bisbenzoxazole, hereinafter referred to as Compound B, having the following formula:

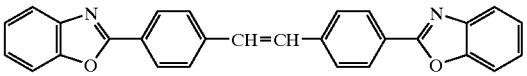

and a 2-[4-[2-[4-(2-benzoxazolyl)phenyl]ethenyl]phenyl]-5-dimethylbenzoxazole, hereinafter referred to as Compound C, having the following formula:

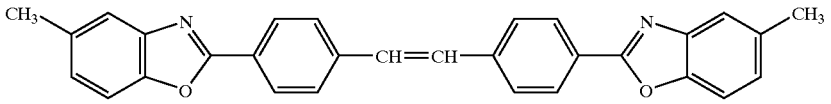

wherein the layers below the uppermost layer of the at least two polyolefin layers comprise migratory optical brightener, and wherein the imaging layer is on the same side of the base material as the at least two polyolefin layers.

ADVANTAGEOUS EFFECTS OF THE INVENTION

The present invention includes several advantages, not all of which are incorporated in a single embodiment. One advantage may be that the photographic support of the invention unexpectedly minimizes exudation of the brightener at the polyolefin surface, when a particular mixture of optical brighteners is incorporated into the top or uppermost pigmented polyolefin layer. Another advantage may be the excellent absorption/emission characteristics, brightening power and heat stability that is achievable with this mixture in the uppermost layer of the present invention to meet the critical requirements of the photographic field. Another advantageous feature of the invention may be that such support exhibits excellent brightness at very low brightener concentration. Yet another advantageous feature of this invention may be the stability of the optical brightener mixture at the temperatures, as high as 310–330 C. Other advantages of the invention will become apparent upon reference to the following description of the preferred embodiments.

DETAILED DESCRIPTION OF THE INVENTION

The present invention relates to an imaging element comprising at least one imaging layer and a support. The support comprises a base material with at least two polyolefin layers on the same side of the support as the imaging layers, the uppermost polyolefin layer of which includes a non-migratory mixture of optical brighteners, and the polyolefin layers below the uppermost polyolefin layer comprise migratory optical brightener. The invention is described particularly with regard to preferred embodiments as an optically brightened photographic support and a photographic element comprising such support. However, the invention may be useful in other applications wherein an optically brightened polyolefin coating resistant to brightener exudation is desired. The mixture of optical brighteners used in the practice of the present invention exhibits absorption/emission characteristics as good as or better than other brighteners presently utilized in photographic print materials. Further, this mixture provides the desired brightening power at low brightener concentrations, which is commercially attractive from a cost saving standpoint. The disclosed optical brightener mixture has been found to be stable to temperatures as high as 330 C. Moreover, the unexpected advantageous resistance of an imaging element according to the present invention to brightener exudation at the polyolefin surface of the support is advantageously exhibited when rolls of the coated support material are stored for prolonged periods of time, such as weeks or months.

The terms as used herein, "top", "upper", "emulsion side", and "face" mean the side or toward the side of the element carrying the imaging layer or layers. The terms "bottom", "lower side" and "back" mean the side opposite of the imaging layers. The term as used herein, "transparent" means the ability to pass radiation without significant deviation or absorption. The term as used herein "uppermost" or refers to the layer directly below and in contact with the imaging layer or layers.

The photographic support used in this invention comprises a base material, most preferably paper, having thereon at least two polyolefin coating layers, the topmost of which comprises a mixture of optical brighteners which are fluorescent is (benzoxazolyl)stilbenes. Such mixture comprises the following compounds:

Compound A

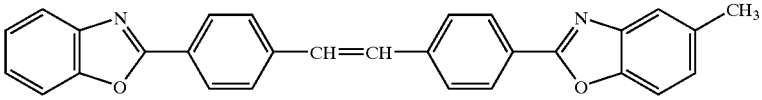

Compound B

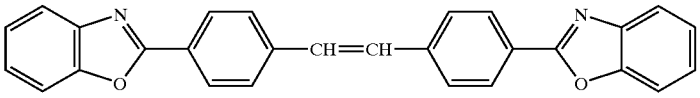

Compound C

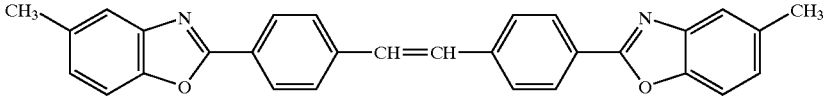

The mixture of optical brighteners useful herein comprises the above-noted bis(benzoxazolyl)stilbenes, which are known optical brighteners. This mixture is also a known mixture for optical brightening use in polyolefin fibers, as described in U.S. Pat. No. 3,366,575, but its use in the polyolefin layer of a photographic element has not been disclosed nor suggested heretofore. To obtain such mixture, the individual compounds may be mixed according to conventional means or the mixture may be obtained as the product of the method of synthesis utilized.

The individual compounds may be prepared by methods known in the art. For example, Compound A may be prepared by chlorination of a (benzoxazolyl) stilbenecarboxylic acid and subsequent reaction with an aminophenol. Details of such a preparation may be found in U.S. Pat. No. 4,282,355, the disclosure of which is hereby incorporated by reference. Compound B may be prepared by the method described in U.S. Pat. No. 3,260,715, the disclosure of which is hereby incorporated by reference. Briefly, such method, illustrated particularly in Example 1 of U.S. Pat. No. 3,260,715, comprises chlorination of a 4,4'-stilbenedicarboxylic acid and subsequent reaction with o-aminophenol. Compound C may be prepared as described in U.K. Patent Specification No. 1,026,368, the disclosure of which is hereby incorporated by reference. Such preparation comprises the step of reacting 1-amino-2-hydroxy-5-methylbenzene with 4,4'-stilbenedicarboxylic acid. Alternatively, the mixture of A, B and C may be conveniently obtained as a reaction product. For example, the mixture may be obtained by reaction 4,4'-stilbene dicarboxylic acid with 1-amino-2-hydroxy-5-methylbenzene and 1-amino-2-hydroxybenzene in various proportions. This method is further described in U.S. Pat. No. 3,366,575, the disclosure of which is hereby incorporated by reference.

The relative amounts of Compounds A, B and C required to be present in the mixture to achieve the intended effects may be widely varied, as desired. Preferred mixtures include by weight from 15 to 90% of Compound A, from 5 to 70% of Compound B, and from 5 to 70% of Compound C, such percentages being based on the total weight of the mixture. Highly preferred mixtures include from 40 to 70% of Compound A, from 10 to 35% of B, and from 10 to 35% of C. It is believed that the unexpected resistance to brightener exudation may be due at least partly to an unusual crystalline form of the mixture, which is more soluble and/or more stable in the polyolefin than the individual components of the mixture.

The amount of the brightener mixture, which is used in the present invention, is an amount effective to brighten the reflective layer. Such amounts of the mixture may be from 0.001% to 0.25% by weight based on the total weight of the polyolefin coating, including the white pigment. Excellent brightening with no or minimal, but acceptable, exudation has resulted when the mixture is present in an amount of 0.01% to 0.10% in the polyolefin coating. As noted, the mixture is stable to the temperatures as high as from 310 C to 330 C.

The polyolefin may be any coatable polyolefin material known in the photographic art. Representative of these materials are polyethylene, polypropylene, polystyrene, polybutylene, and copolymers thereof. Polyethylene of low, linear low, medium or high density is preferred. The polyolefin may be copolymerized with one or more copolymers including polyesters, such as polyethylene terephthalate, polysulfones, polyurethanes, polyvinyls, polycarbonates, cellulose esters, such as cellulose acetate and cellulose propionate, and polyacrylates. Specific examples of copolymerizable monomers include vinyl stearate, vinyl acetate, acrylic acid, methyl acrylate, ethyl acrylate, acrylamide, methacrylic acid, methyl methacrylate, ethyl methacrylate, methacrylamide, butadiene, isoprene, and vinyl chloride. Preferred polyolefins are film forming and adhesive to paper. Polyethylene having a density in the range of from 0.910 g/cm$^3$ to 0.980 g/cm$^3$ is particularly preferred.

The prior art has focused on a single layer of polymer, for example, polyolefin, on a cellulose paper core. The present application includes multilayer polyolefin structures, such as those achieved by multiple coatings, either sequential or via coextrusion. To minimize the number of resins required while still obtaining the migration advantage, a structure consisting of 2 or 3 layers is preferred. In one embodiment of the present invention, at least one layer below the uppermost layer further comprises polypropylene or polypropylene in combination with a polyolefin. In a more preferred embodiment, the polypropylene layer below the uppermost layer further comprises migratory optical brightener. In another preferred embodiment, the polypropylene is present in the layer containing migratory optical brightener in the amount of at least 5, and more preferably at least 10, weight percent polypropylene. In another preferred embodiment, the imaging element comprises an uppermost layer, a lowermost layer, and an inner layer therebetween. In another preferred embodiment, the imaging element comprises an uppermost layer, a lowermost layer, and an inner layer therebetween containing polypropylene, alone or in combination with polyolefin, and migratory optical brightener. In another preferred embodiment, the lowermost layer comprises the same composition as the uppermost layer. In another preferred embodiment, the lowermost layer comprises the same composition as the uppermost layer, especially with respect to non-migratory optical brightener. The ratio of thickness of the center or bottom layer to the outer or top layer is in the range of 1 to 8 with 5 to 7 being most preferable. In the case of a 3-layer structure, the composition and thickness of the topmost and bottommost layers are, preferably, substantially similar. The outermost layer comprises polyolefin containing, optionally, pigments and other addenda. The relatively thick bottom layer, when two layers are present, or the center layer, when three layers are present, comprises a polyolefin containing a migratory optical brightener and preferably, pigment. The outermost layer acts as a barrier to the optical brightener in the bottom or center layer.

The migratory optical brightener compounds utilized in the invention are fluorescent compounds of Formula I:

Formula I

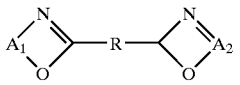

in which the radical R is a bivalent 4,4'-stilbene radical and each of the radicals $A_1$ and $A_2$ is an o-phenylene radical, as described in U.S. Pat. No. 3,260,715.

The migratory optical brightener compounds utilized in this invention are comprised of stilbene derivatives having benzoxazolyl substituents in the 4,4' positions of the stilbene radicals. The compounds of this class have unexpectedly superior fluorescent properties when used as whitening or brightening agents and, in addition, have certain other properties, including but not limited to heat stability, light stability, stability toward bleaches, and stability in textile processing treatments, which make them especially useful as whitening or brightening agents for use in thermoplastic coatings, preferably in the extrusion coating, casting or orienting of polyolefin films.

In Formula 1, R may be a bivalent 4,4'-stilbene radical of Formula II:

Formula II

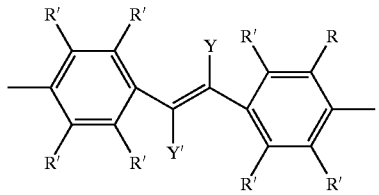

and each of $A_1$ and $A_2$ is an o-phenylene radical of Formula III:

Formula III

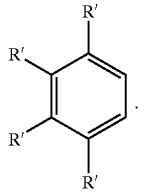

The substituents R' of the bivalent 4,4'-stilbene radical and of each of the o-phenylene radicals may be the same or different monovalent substituents bound to the ring by a covalent bond and can be any such substituent which does not destroy the desirable fluorescent properties of the 4,4'-bis(benzoxazol-2-yl)stilbene compound.

The substituents Y and Y' of the 4,4'-stilbene radical may be the same or different monovalent substituents bound to the respective carbon atoms to which they are attached by a covalent bond and can be any such substituent which does not destroy the desirable fluorescent properties of the 4,4'-bis(benzoxazol-2-yl)stilbene compound.

Typical monovalent substituents Y and Y' which are suitable may include a hydrogen atom and alkyl, aryl and cyano radicals. When Y or Y' is alkyl it is preferably alkyl of 1 to 18 carbon atoms such as methyl, ethyl, n-butyl, i-butyl, 2-ethylhexyl, n-pentyl, n-hexyl, n-decyl, dodecyl or cetyl, for example. When Y or Y' is aryl it is preferably mononuclear aryl such as phenyl, methylphenyl, methoxyphenyl, ethylphenyl, chlorophenyl and bromophenyl for example.

Typical monovalent substituents R' which may be suitable include a hydrogen atom, a halogen atom and alkyl, aryl, substituted aryl, hydroxy, alkoxy, aryloxy, acyl, acyloxy, amino, substituted amino, quaternized ammonium, sulfo, substituted sulfonyl, sulfamyl, substituted sulfamyl, cyano, thiocyano, thiol, carbamyl, substituted carbamyl, carbamoyloxy, and nitro groups, for example. The monovalent substituents named are illustrative, and not limitative, because, as noted, any monovalent substituent bound to the ring by a covalent bond which does not destroy the desirable fluorescent properties of the 4,4'-bis(benzoxazol-2-yl) stilbene compound can be present.

Chlorine, bromine, fluorine and iodine atoms are illustrative of the halogen atoms represented by R'. When R' is alkyl it preferably has 1 to 18 carbon atoms, such as methyl, ethyl, propyl, isopropyl, n-butyl, isobutyl, n-pentyl, n-hexyl, n-decyl, n-dodecyl, n-hexadecyl, or noctadecyl, for example. When R' is aryl or substituted aryl it is preferably mononuclear aryl such as phenyl, methylphenyl, ethylphenyl, chlorophenyl, bromophenyl, methoxyphenyl, ethoxyphenyl or other substituted phenyl nuclei. However, R' can also be an aryl nucleus such as 1-naphthyl or 2-naphthyl and substituted derivatives thereof, or a heterocyclic nucleus such as furyl, and thienyl, for example. Illustrative of the alkoxy groups represented by R' are alkoxy groups having from 1 to 18 carbon atoms, and preferably from 1 to 4 carbon atoms, such as methoxy, ethoxy, propoxy, isopropoxy, n-butoxy, isobutoxy, n-amoxy, isoamoxy and bexoxy, for example.

Phenoxy and naphthoxy are illustrative aryloxy groups represented by R'. Formyl, acetyl, propionyl, butyryl, isobutyryl, benzoyl and naphthoyl, for example are illustrative of the acyl groups represented by R'. Acetoxy, benzoxy, CH3CH2COO—, CH3CH2CH2COO— and CH,CI—ICH, CH2CH1COO—, for example, are illustrative of the acyloxy groups represented by R'. Monoalkylamino, dialkylamino, wherein the alkyl groups are the same or different, arylamino, aralkylamino, cycloalkylamino, monohydroxyalkylan-lino, dihydroxyalkylamino alkoxyalkylamino and other aliphatic-amino groups, for example—are illustrative of the substituted amino groups represented by R'. Normally the alkyl, hydroxyalkyl or alkoxyalkyl groups present in such amino groups contain no more than 4 carbon atoms although they can contain more.

Illustrative of the substituted sulfonyl groups represented by R' are alkylsulfonyl groups having from 1 to 18 carbon atoms and preferably from 1 to 4 carbon atoms such as methylsulfonyl, ethylsulfonyl, propylsulfonyl, butylsulfonyl, etc., and arylsulfonyl, preferably mononuclear arylsulfonyl such as phenylsulfonyl, methylphenylsulfonyl, chlorophenylsulfonyl and ethoxyphenylsuffonyl.

Illustrative of the substituted sulfamyl groups represented by R' are alkyl and dialkylsulfamyl such as N,Ndimethysulfamyl, N,N-diethylsulfamyl, N,N-dipropylsuffamyl, N-ethylsulfamyl, N— methylsulfamyl, N-butylsulfamyl, and N-ethyl-N-butylsulfamyl; aryl and diarylsulfamyl such as N-phenylsulfamyl, N,N-diphenylsulfamyl, N,N-diethylphenylsulfamyl; N-phenyl-N-ethylphenylsulfamyl, N,N-dibutylphenylsulfamyl and N-ethoxyphenylsulfamyl; N-alkyl-N-arylsulfamyl such as Nethyl-N-phenylsulfamyl, N-methyl-N-(methoxyphenyl) sulfamyl and N-butyl-N-chlorophenylsulfamyl.

Illustrative of the substituted carbamyl groups represented by R' are alkylcarbamyl and dialkylcarbamyl groups wherein the alkyl radicals preferably contain from 1 to 4 carbon atoms, such as N-methylcarbamyl, N-ethyl3 carbamyl, N-propyplcarbamyl, N-isopropylycarbamyl, Nbutylcarbamyl, N,N-dimethylcarbamyl, N,N-diethylcarbamyl, N,N-dibutylcarbamyl and N-ethyl-Nmethylcarbamyl; aryl and diarylcarbamyl such as Nphenylcarbamyl, N,N-diphenylcarbamyl, N,N-di (ethylphenyl)carbamyl and N,N-di(methoxyphenyl) carbamyl.

R' may also be a —OC—N—NHSO2Q; —NSQ1 acyl acyl/acyl —N—N—C-oQ acyl SO2QOQ-NHC—N11VQ1 group, for example, wherein Q and Q, each are a hydrogen atom, an alkyl group (preferably having 1 to 4 carbon atoms), a substituted alkyl group (preferably having no more than 4 carbon atoms), an aryl group (such as phenyl, methylphenyl, ethylphenyl, methoxyphenyl, ethoxyphenyl, chlorophenyl or bromophenyl, for example) and a cycloalkyl group (such as cyclobutyl, cyclopentyl or cyclohexyl). The term acyl, unless other wise indicated, is used broadly and includes, in addition to acyl groups, groups such as the ureido group, —SO2Q groups and

—NH—C—N

N Q1Q groups, wherein Q and Q, have the meaning previously assigned to them.

R' can also be a fluorinated alkyl group having 1 to 18 carbon atoms. Difluoroalkyl groups having the formula —(C,H2)nCH.F2 and trifluoroalkyl groups having the formula —(CH2),CF3 wherein n is a whole number from 1 to 17 are illustrative. Higher fluorinated alkyl groups such as —(CH2)m, (CF2)m-CF3 where m is 1 to 4, for example, and m, is 1 or 2, can also be present. 2,2difluoroethyl, 3,3-difluoro-n-propyl, 4,4-difluoro-n-butyl, 5,5-difluoro-n-amyl, 6,6-difluoro-n-hexyl, 2,2,2-trifluoroethyl, 3,3,3-trifluoro-n-propyl, 4,4,4-trifluoro-nbutyl, 5,5,5-trifluoro-n-amyl, 6,6,6-trifluoro-n-hexyl, 5-CH2CH2CF3; —CH2CH2CF2CF3; —CH2CH2CH2CF2CF3 and —CH2CH2CF2CF2CF3 are illustrative of the fluorinated alkyl groups which R' can be.

R' can also be an unsaturated acyclic hydrocarbon radical such as allyl, 1-butenyl, 2-butenyl, 3-butenyl, 1-pentenyl, 2-pentenyl, 3-pentenyl, isobutenyl and 1-isopentenyl for example.

Normally no more than 1 of the R' substituents present in each of the phenyl nuclei of the bivalent 4,4'-stilbene radical is other than a hydrogen atom. The simpler 4,4'-bis(benzoxazol-2-yl)stilbene compounds are often preferred because they are cheaper, more easily prepared and, in some instances, are better fluorescent brightening agents than the more complex 4,4'-bis(benzoxazol-2-yl)stilbene compounds.

The optical brightener mixture may be incorporated into the polyolefin by conventional methods. Preferred are methods whereby the brightener is uniformly dispersed within the polyolefin. Such methods include a melt extrusion process, a kneader extruder, a roll mill, a high shear mixer, or a twin-screw compounder.

Pigment may be included in the polyolefin layers. Representative pigments may include titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten and combinations thereof. The pigment may be used in any form that is conveniently dispersed within the polyolefin. The preferred pigment is titanium dioxide. The titanium dioxide preferably is anatase, rutile or combinations of these forms. Enhanced image resolution in a photographic element may be obtained by the addition of functional amounts of such highly white-light reflective pigments to the polyolefin layer. Preferably, the white pigment is used in the range from 3 to 35%, more preferably 5 to 25% by weight based on the total weight of the polyolefin coating. Titanium dioxide at levels of 5 to 20% is particularly useful.

The polyolefin coating may contain, if desired, a variety of additives including antioxidants such as 4,4'-butylidene-bis(6-tert-butyl-meta-cresol), di-lauryl-3,3'-thiodipropionate, N-butylated-p-aminophenol, 2,6-di-tert-butyl-p-cresol, 2,6-di-tert-butyl-4-methylphenol, N,N-disalicylidcne-1,2-diaminopropane, tetra(2,4-di-tert-butylphenyl)-4,4'-diphenyldiphenyldiphosphonite, octadecyl 3-(3',5'-di-tert-butyl-4'-hydroxyphenyl propionate), combinations of the above, heat stabilizers, such as higher aliphatic acid metal salts such as magnesium stearate, calcium stearate, zinc stearate, aluminum stearate, calcium palmitate, sodium palmitate, zirconium octylate, sodium laurate, and salts of benzoic acid such as sodium benzoate, calcium benzoate, magnesium benzoate and zinc benzoate, additional optical brighteners, antistatic agents, dispersing agents, coating aids, slip agents, lubricants, dyes, as is well known to those skilled in the art. Additionally, image side resins may contain one or more pigments, such as the blue, violet or magenta pigments described in U.S. Pat. No. 3,501,298, or pigments such as barium sulfate, colloidal silica, calcium carbonate. The polyolefin layers may also contain filler materials, such as stiffening agents, for example, zinc oxide, talc or calcium carbonate.

The base material utilized with the present invention may be any support conventionally used to support imaging layers. The paper base material employed in accordance with the invention may be any paper base material, which has heretofore been considered useful for a photographic support. It is preferred to use a paper base material calendered to a smooth surface. The paper base material may be made from any suitable paper stock preferably comprising hard or softwood. Either bleached or unbleached pulp may be utilized as desired. The paper base material may also be prepared from partially esterified cellulose fibers or from a blend of wood cellulose and a suitable synthetic fiber such as a blend of wood cellulose and polyethylene fiber. Smooth opaque paper bases are useful in combination with silver halide images because the contrast range of the silver halide image is improved, and show through of ambient light during image viewing is reduced. The most preferred bases are raw or coated paper base or synthetic paper, including synthetic papers having a closed cell blown foam core. The bases may further comprise polyolefin sheets, including oriented polypropylene sheets. The weight and thickness of the support may be varied depending on the intended use. A preferred weight range is from 20 g/m$^2$ to 500 g/m$^2$. Preferred thicknesses, corresponding to commercial grade photographic paper, are from 20 $\mu$m to 500 $\mu$m.

As is known to those skilled in the art, the paper base material may contain agents to increase the strength of the paper such as wet strength resins, such as, the amino-aldehyde or polyamide-epichlorohydrin resins, and dry strength agents, for example, starches, including both ordinary starch and cationic starch, or polyacrylamide resins. In a preferred embodiment of this invention, the amino-aldehyde, polyamide-epichlorohydrin and polyacrylamide resins are used in combination as described in U.S. Pat. No. 3,592,731. Other conventional additives include water soluble gums, for example, cellulose ethers such as carboxymethyl cellulose, sizing agents, such as, a ketene dimer, sodium stearate which is precipitated onto the pulp fibers with a polyvalent metal salt such as alum, aluminum chloride or aluminum sulfate, fluorescing agents, antistatic agents, fillers, including clays, pigments, or stiffening agents such as titanium dioxide, dyes.

The coating of the paper base material with the polyolefin preferably is by extrusion from a hot melt as is known in the art. The invention may be practiced within a wide range of extrusion temperatures, for example, from 150 C to 350 C, and speeds, for example, from 60 m/min. to 460 m/min., depending on the particular intended application of the support. For many applications, preferred extrusion temperatures are from 310 C to 330 C. As noted, it may be advantageous that the mixture of optical brighteners is stable to such temperatures. Under these conditions, the aforedescribed polyolefin coating, over which the silver halide emulsion is applied, may be coated onto the paper base material in a coverage of from 1 to 100 g/m$^2$, at a uniform thickness ranging from 1 to 100 $\mu$m. About the same coverage of clear polyethylene coating preferably is applied to the side of the paper base material opposite to the pigmented polyolefin coating. As such, the polyolefin coatings may be particularly effective in preventing acid and alkaline photographic processing solutions from penetrating to the paper base.

The imaging member of the invention may also comprise a polymer foam core that has adhered thereto an upper and a lower flange sheet as disclosed in U.S. Pat. Nos. 6,537,656 and 6,447,976 incorporated herein by reference. The polymer foam core comprises a homopolymer such as a polyolefin, polystyrene, polyvinylchloride or other typical thermoplastic polymers, their copolymers or their blends thereof, or other polymeric systems like polyurethanes, polyisocyanurates that has been expanded through the use of a blowing agent to consist of two phases, a solid polymer matrix, and a gaseous phase. Other solid phases may be present in the foams in the form of fillers that are of organic (polymeric, fibrous) or inorganic (glass, ceramic, metal) origin. The fillers may be used for physical (stiffness), optical (lightness, whiteness, and opacity), chemical, or processing property enhancements of the foam.

The foaming of these polymers may be carried out through various mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure, the volatilization of low-boiling liquids such as fluorocarbons or methylene chloride. The choice of foaming technique is dictated by desired foam density reduction, desired properties, and manufacturing process. If necessary, these foaming agents may be used together with an auxiliary foaming agent, nucleating agent, and a cross-linking agent.

The flange sheets used with the foam core may be chosen to satisfy specific requirements of flexural modulus, caliper, surface roughness, and optical properties such as colorimetry and opacity. The flange members may be formed integral with the foam core by manufacturing the foam core with a flange skin sheet or the flange may be laminated to the foam core material.

In the design of the foam core elements, there exists a relationship between stiffness of the imaging element and the caliper and modulus of the foam core and modulus of the flange sheets, i.e., for a given core thickness, the stiffness of the element may be altered by changing the caliper of the flange elements and/or changing the modulus of the flange elements and/or changing the modulus of the foam core. If the target overall stiffness and caliper of the foam core imaging element are specified then for a given core thickness and core material, the target caliper and modulus of the flange elements are implicitly constrained. Conversely, given a target stiffness and caliper of the foam core imaging element for a given caliper and modulus of the flange sheets, the core thickness and core modulus are implicitly constrained.

Preferred ranges of foam core caliper and modulus and flange caliper and modulus follow: the preferred caliper of the foam core ranges from 25 $\mu$m to 350 $\mu$m, the caliper of the flange sheets ranges from 10 $\mu$m to 175 $\mu$m, the modulus of the foam core ranges from 30 MPa to 1000 MPa, and the modulus of the flange sheets ranges from 700 MPa to 10500 MPa. In each case, the above range is preferred because of (a) consumer preference, (b) manufacturability, and (c) materials selection. It is noted that the final choice of flange and core materials, modulus, and caliper will be a subject of the target overall element stiffness and caliper.

The range in density reduction of the foam core is from 20% to 95%. The preferred range in density reduction is from 40% to 70%. This is because it is difficult to manufacture a uniform product with very high density reduction (over 70%). Density reduction is the percent difference between solid polymer and a particular foam sample. It is also not economical to manufacture a product with density reduction less than 40%.

The selection of core material, the extent of density reduction (foaming), and the use of any additives/treatments for, such as, cross-linking the foam, determine the foam core modulus. The selection of flange materials and treatments (for example, the addition of strength or stiffening agents for paper base or the use of filler materials for polymeric flange materials) determines the flange modulus. In a preferred lamination embodiment of the foam core element useful with the present invention, the flange sheets used comprise paper.

In another preferred lamination embodiment of the foam core element useful with the present invention, the flange sheets used comprise high modulus polymers such as high density polyethylene, polypropylene, or polystyrene, their blends or their copolymers, that have been stretched and oriented. They may be filled with suitable filler materials as to increase the modulus of the polymer and enhance other properties such as opacity, stiffness, and smoothness. Useful polymer flange sheets may be of caliper from 10 $\mu$m to 150 $\mu$m, preferably from 35 $\mu$m to 70 $\mu$m.

In another embodiment the foam core element useful with the invention, the flange sheets used comprise paper on one side and a high modulus polymeric material on the other side. In another embodiment, an integral skin may be on one side and another skin laminated to the other side of the foam core.

In addition, it may be necessary to use various additives such as antioxidants, slip agents, or lubricants, and light stabilizers in the polymeric elements as well as biocides in the paper elements. These additives are added to improve, among other things, the dispersibility of fillers and/or colorants, as well as the thermal and color stability during processing and the manufacturability and the longevity of the finished article. For example, polyolefin coatings may contain antioxidants such as 4,4'-butylidene-bis(6-tert-butyl-meta-cresol), di-lauryl-3,3'-thiopropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), combinations of the above, heat stabilizers, such as higher aliphatic acid metal salts such as magnesium stearate, calcium stearate, zinc stearate, aluminum stearate, calcium palmitate, zirconium octylate, sodium laurate, and salts of benzoic acid such as sodium benzoate, calcium benzoate, magnesium benzoate and zinc benzoate, light stabilizers such as hindered amine light stabilizers (HALS), of which a preferred example is poly{[6-[(1,1,3,3-tetramethylbutylamino}-1,3,5-triazine-4-piperidinyl)-imino]-1,6-hexanediyl[{2,2,6,6-tetramethyl-4-piperdinyl) imino-]}(Chimassorb® 944 LD/FL).

The foam core elements, paper base or other support useful with the present invention may also be provided with additional layers that may serve to change the properties of the element. Imaging elements could be formed with surface layers that would provide an improved adhesion or look. The support may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. The base material may be treated with corona discharge to obtain good adhesion before the polyolefin coating is extruded thereon, as described in U.S. Pat. No. 3,411,908. Further examples include flame, or plasma treatment to improve printability or adhesion.

The imaging element utilized in the present invention preferably comprises more than a single layer in the support. One preferred method of achieving multiple coated layers of polyolefins in a single coating pass using a single coating station is coextrusion, where multiple resin compositions are supplied by multiple extruders and formed into multiple layers using appropriate feedblocks or extrusion dies. For our purposes, using two resin compositions to form 2 or 3 layers has been most suitable. Another method of achieving multiple coated layers may be by simultaneous serial extrusion.

Another preferred method of achieving multiple coated layers of polyolefins in a single coating pass is by means of sequential extrusion. Multiple formulations were sequentially applied one over another on the same paper, in multiple coating passes by methods and means known to those skilled in the art.

Used herein, the phrase 'imaging element' comprises an imaging support as described above along with an image receiving layer as applicable to multiple techniques governing the transfer of an image onto the imaging element. Such techniques include thermal dye transfer, electrophotographic printing, or ink jet printing, as well as a support for photographic silver halide images. As used herein, the phrase "photographic element" is a material that utilizes photosensitive silver halide in the formation of images. This invention is directed towards a photographic recording element comprising a support and at least one imaging layer which may comprise alight sensitive silver halide emulsion layers comprising silver halide grains, ink jet receiving elements, thermal dye transfer elements and electrophotographic elements. In particular, the above mentioned imaging technologies do not require a separate printing and chemical development process and are capable of printing images from a digital file which allows digital printing of packaging pressure sensitive labels.

The thermal dye image-receiving layer of the receiving elements utilized with the invention may comprise, for example, a polycarbonate, a polyurethane, a polyester, polyvinyl chloride, poly(styrene-co-acrylonitrile), poly (caprolactone), or mixtures thereof. The dye image-receiving layer may be present in any amount that is effective for the intended purpose. In general, good results have been obtained at a concentration of from 1 to 10 $g/m^2$. An overcoat layer may be further coated over the dye-receiving layer, such as described in U.S. Pat. No. 4,775,657 of Harrison et al.

Dye-donor elements that may be used with the dye-receiving element utilized in the invention conventionally comprise a support having thereon a dye containing layer. Any dye may be used in the dye-donor employed with the invention, provided it is transferable to the dye-receiving layer by the action of heat. Especially good results have been obtained with sublimable dyes. Dye donors applicable for use in the present invention are described, for example, in U.S. Pat. Nos. 4,916,112, 4,927,803, and 5,023,228. As noted above, dye-donor elements are used to form a dye transfer image. Such a process comprises image-wise-heating a dye-donor element and transferring a dye image to a dye-receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. When the process is only performed for a single color, then a monochrome dye transfer image is obtained.

Thermal printing heads which may be used to transfer dye from dye-donor elements to receiving elements utilized with the invention are available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage utilized in the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps, the use of liquid toners in place of dry toners is simply one of those variations.

The first basic step, creation of an electrostatic image, may be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process; electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the toner particle. Heating both removes residual liquid and fixes the toner to paper.

When used as ink jet imaging media, the recording elements or media typically comprise a substrate or a support material having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, may be applied to the surface of the support. The ink receiving layer is preferably coated onto the support layer from water or water-alcohol solutions at a dry thickness ranging from 3 to 75 micrometers, preferably 8 to 50 micrometers.

Any known ink jet receiver layer may be used in combination with the external polyester-based barrier layer of the present invention. For example, the ink receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer may be overcoated with an ink-permeable, anti-tack protective layer such as, for example, a layer comprising a cellulose derivative or a cationically-modified cellulose derivative or mixtures thereof. An especially preferred overcoat is poly β-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water-based inks. The overcoat layer may also protect the ink receiving layer from abrasion, smudging, and water damage. In general, this overcoat layer may be present at a dry thickness of 0.1 to 5 μm, preferably 0.25 to 3 μm.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers. In addition, a mordant may be added in small quantities (2%–10% by weight of the base layer) to improve water-fastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating. Some of these methods allow for simultaneous coatings of both layers, which is preferred from a manufacturing economic perspective.

The DRL (dye or ink receiving layer) is coated over the tie layer (TL) at a thickness ranging from 0.1–10 μm, preferably 0.5–5 μm. There are many known formulations, which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166, 5,264,275, 5,104,730, 4,879,166, and Japanese Patents 1,095,091, 2,276,671, 2,276,670, 4,267,180, 5,024,335, and 5,016,517 disclose aqueous based DRL formulations comprising mixtures of psuedo-bohemite and certain water soluble resins. Light in U.S. Pat. Nos. 4,903,040, 4,930,041, 5,084,338, 5,126,194, 5,126,195, and 5,147,717 discloses aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly(vinyl alcohol). Iqbal in U.S. Pat. No. 5,208,092 discloses water-based DRL formulations comprising vinyl copolymers, which are subsequently cross-linked. In addition to these examples, there may be other known or contemplated DRL formulations, which are consistent with the aforementioned primary and secondary requirements of the DRL, all of which fall under the spirit and scope of the current invention.

The preferred DRL is 0.1–10 micrometers thick and is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers.

Although the ink-receiving elements as described above may be successfully used to achieve the objectives of the present invention, it may be desirable to overcoat the DRL for the purpose of enhancing the durability of the imaged element. Such overcoats may be applied to the DRL either before or after the element is imaged. For example, the DRL may be overcoated with an ink-permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, and humectants. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

Ink jet receiver coating compositions employed in the invention may be applied by any number of well known techniques, including dip-coating, wound-wire rod coating, doctor blade coating, gravure and reverse-roll coating, slide coating, bead coating, extrusion coating, curtain coating. Known coating and drying methods are described in further detail in Research Disclosure no. 308119, published Dec. 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers, which act upon the binder discussed above, may be added in small quantities. Such an additive improves the cohesive strength of the layer. Crosslinkers such as carbodiimides, polyfunctional aziridines, aldehydes, isocyanates, epoxides, polyvalent metal cations, may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, and antistatic agents. In order to obtain adequate coatability, additives known to those familiar with such art such as surfactants, defoamers, alcohol may be used. A common level for coating aids is 0.01 to 0.30% active coating aid based on the total solution weight. These coating aids may be nonionic, anionic, cationic or amphoteric. Specific examples are described in MCCUTCHEON's Volume 1: Emulsifiers and Detergents, 1995, North American Edition.

The coating composition may be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives. The solvent or carrier liquid may be solely water or may be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946, 4,239,543 and 4,781,758, the disclosures of which are hereby incorporated by reference.

Although the recording elements disclosed herein have been referred to primarily as being useful for ink jet printers, they also may be used as recording media for pen plotter assemblies. Pen plotters operate by writing directly on the surface of a recording medium using a pen consisting of a bundle of capillary tubes in contact with an ink reservoir.

One preferred photographic element of this invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100 $\mu$seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. This invention in a preferred embodiment utilizes a radiation-sensitive emulsion comprised of silver halide grains (a) containing greater than 50 mole percent chloride based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, −1, −2, −3, or −4, M is a filled frontier orbital polyvalent metal ion, other than iridium, and $L_6$ represents bridging ligands which may be independently selected, provided that at least four of the ligands are anionic ligands, and at least one of the ligands is a cyano ligand or a ligand more electronegative than a cyano ligand, and (ii) an iridium coordination complex containing a thiazole or substituted thiazole ligand. Preferred photographic imaging layer structures are described in EP Publication 1 048 977. The photosensitive imaging layers described therein provide particularly desirable images on the pragmatic sheet of this invention. Further, gelatin emulsion tinting may be used to offset the native yellowness of the gelatin and provide a neutral white position. The preferred emulsion tinting method is disclosed in U.S. Pat. No. 6,180,330.

In order to utilize the imaging element of the invention for a label material, the image is preferably protected with an environmental protection layer. The environmental protection layer may consist of suitable material that protects the image from environmental solvents, resists scratching, and does not interfere with the image quality. The environmental protection layer is preferably applied to the photographic image after image development because the liquid processing chemistry required for image development must be able to efficiently penetrate the surface of the imaging layers to contact the silver halide and couplers utilizing typical silver halide imaging processes. The environmental protection layer would be generally impervious to developer chemistry. An environmental protection layer where transparent polymer particles are applied to the topmost surface of the imaging layers in the presence of an electric field and fused to the topmost layer causing the transparent polymer particles to form a continuous polymeric layer is preferred. An electrophotographic toner applied polymer is preferred, as it is an effective way to provide a thin, protective environmental layer to the photographic label that has been shown to withstand environmental solvents and damage due to handling.

In another embodiment, the environmental protection layer is coatable from aqueous solution, which survives exposure and processing, and forms a continuous, water-impermeable protective layer in a post-process fusing step. The environmental protection layer is preferably formed by coating polymer beads or particles of 0.1 to 50 $\mu$m in average size together with a polymer latex binder on the emulsion side of a sensitized photographic product. Optionally, a small amount of water-soluble coating aids (viscosifiers, surfactants) may be included in the layer, as long as they leach out of the coating during processing. After exposure and processing, the product with image is treated in such a way as to cause fusing and coalescence of the coated polymer beads, by heat and/or pressure (fusing), solvent treatment, or other means so as to form the desired continuous, water impermeable protective layer.

The application of a synthetic latex to the developed silver halide label image is another preferred environmental protection layer. A coating of synthetic latex has been shown to provide an acceptable environmental protection layer and may be coated in an aqueous solution eliminating exposure to solvents.

In a preferred embodiment of this invention, a conventional UV absorbing agent is disposed in the photographic element to enhance speed and improve image stability and/or sharpness.

EXAMPLES

The following examples are provided to illustrate the invention.

Testing of Optical Brightener Migration Used the Following Procedure:

Ten samples measuring 7.5 cm×22.5 cm were cut from each variation. Samples were examined under ultraviolet light before placing into an oven maintained at 43.3 C. The samples were stacked and placed in a weighted sample holder with circular brass pads of 27 mm. diameter. Two 895-gm weights were placed on the sample holder to yield 100-psi (6.896 bars) pressure on the samples during incubation. Samples were periodically removed from the oven and examined under ultraviolet light for evidence of optical brightener migration. For each examination, one sample was removed and discarded after examination while the remaining samples were returned to the oven. In some cases because of the quantity of samples, the samples were freely hung in the oven maintained at 43.3 C instead of weighted. Test duration was up to 56 days.

Extrusion coating onto paper was in one of several possible configurations. In the case of a monolayer coating, a single extruder was used to coat a single formulation in a single coating pass. In the case of coextrusion, different formulations were supplied by different extruders but applied at a single coating station in a single pass on the same paper. In the case of sequential extrusion, multiple formulations were sequentially applied one over another on the same paper, in multiple coating passes.

The Examples were Coated on the Following Commercial Grade Paper Support:

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% titanium dioxide (TiO2) on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

Example 1

A composition consisting of 12.5% anatase TiO2, 0.1% phenolic antioxidant, 0.5% calcium stearate, 0.165% cobalt blue pigment, 0.004% quinacridone red pigment, and 0.05% Hostalux® KS optical brightener (a commercially available mixture of Compound A, Compound B, and Compound C manufactured by Clariant Corp.) in commercially available low density polyethylene was extrusion coated as a monolayer on to paper support at a coverage of 25.4 g/m2 (25.9 microns). This composition showed no optical brightener migration.

Example 2

A composition consisting of 12.5% anatase TiO2, 0.1% phenolic antioxidant, 0.5% calcium stearate, 0.165% cobalt blue pigment, 0.004% quinacridone red pigment, and 0.05% Eastobrite® OB-1 optical brightener (2,2-(1,2-Ethendiyldi4, 1-phenylene)bisbenzoxazole optical brightener, commercially available from Eastman Chemical Company) in commercially available low density polyethylene was extrusion coated as a monolayer on to paper support at a coverage of 25.1 g/m2 (25.7 microns). This composition showed severe optical brightener migration.

Example 3

A composition consisting of 12.5% anatase TiO2, 0.1% phenolic antioxidant, 0.5% calcium stearate, 0.165% cobalt blue pigment, 0.004% quinacridone red pigment, and 0.22% Uvitex® OB optical brightener (2,5-(di-5-tert-butylbenzoyl) thiophenate, commercially available optical brightener manufactured by Ciba-Geigy) in commercially available low density polyethylene was extrusion coated as a monolayer on to paper support at a coverage of 25.9 g/m2 (26.4 microns). This composition showed severe optical brightener migration.

Example 4

A composition consisting of 12.5% anatase TiO2, 0.1% phenolic antioxidant, 0.5% calcium stearate, 0.165% cobalt blue pigment, 0.004% quinacridone red pigment, and 0.05% Kayalight® O optical brightener (Kayalight® O is a commercially available optical brightener manufactured by Nippon Kayaku KK which, like Hostalux® KS, is a mixture of Compounds A, B, and C but is migratory) in commercially available low density polyethylene was extrusion coated as a monolayer on to paper support at a coverage of 25.7 g/m2 (26.3 microns). This composition showed severe optical brightener migration.

Example 5

A repeat of Example 1 was evaluated. A composition consisting of 12.5% anatase TiO2, 0.1% phenolic antioxidant, 0.5% calcium stearate, 0.165% cobalt blue pigment, 0.004% quinacridone red pigment, and 0.05% Hostalux® KS optical brightener in commercially available low density polyethylene was extrusion coated as a monolayer on to paper support at a coverage of 26.0 g/m2 (26.5 microns). This composition showed no optical brightener migration.

Example 6

A repeat of Example 2 was evaluated. A composition consisting of 12.5% anatase TiO2, 0.1% phenolic antioxidant, 0.5% calcium stearate, 0.165% cobalt blue pigment, 0.004% quinacridone red pigment, and 0.05% Eastobrite® OB-1 optical brightener in commercially available low density polyethylene was extrusion coated as a monolayer on to paper support at a coverage of 26.2 g/m2 (26.7 microns). This composition showed severe optical brightener migration.

TABLE 1

| Example # | g/m2 | microns | Extrusion | | Migration |
|---|---|---|---|---|---|
| 1 | 25.39 | 25.94 | MONO | 0.05% Hostalux ® KS | None |
| 2 | 25.14 | 25.69 | MONO | 0.05% Eastobrite ® OB-1 | Severe |
| 3 | 25.88 | 26.44 | MONO | 0.22% Uvitex ® OB | Severe |
| 4 | 25.73 | 26.29 | MONO | 0.05% Kayalight O ® | Severe |
| 5 | 25.97 | 26.54 | MONO | 0.05% Hostalux ® KS | None |
| 6 | 26.17 | 26.74 | MONO | 0.05% Eastobrite ® OB-1 | Severe |

Examples 1–6 confirm the migratory behavior of various optical brighteners in pigmented low density polyethylene formulations coated as monolayers and the nonmigratory behavior of the present inventive mixture of Compounds A, B, and C, hare, Hostalux® KS, which is documented in the prior art (U.S. Pat. Nos. 4,859,539 and 4,794,071).

Example 7

A composition consisting of 9.9% rutile TiO2, 0.03% phenolic antioxidant, 0.05% zinc stearate, 0.15% cobalt blue pigment, 0.003% quinacridone red pigment, and 0.05% Hostalux® KS optical brightener in commercially available low density polyethylene was extrusion coated as a monolayer on to paper support at a coverage of 23.9 g/m2 (25.6 microns).

Example 8

A composition consisting of 9.9% rutile TiO2, 0.03% phenolic antioxidant, 0.05% zinc stearate, 0.15% cobalt blue pigment, 0.003% quinacridone red pigment, and 0.05% Eastobrite® OB-1 in commercially available low density polyethylene was extrusion coated as a monolayer on to paper support at a coverage of 23.5 g/m2 (25.2 microns).

TABLE 2

| SAMPLE | A | Migration |
|---|---|---|
| Monolayer-Example 7 | 874P:0.05% Hostalux ® KS | None |
| Monolayer-Example 8 | L02-071L 0.05% OB-1 | Severe |

Note: If polymer is not specified, it is LDPE.
Note: OB loading is 0.05% unless specified The monolayer coated paper was tested for optical brightener migration as described in the test procedure and was found to have no migration in the case of the mixture of optical brighteners comprising the uppermost layer in the presence of rutile titanium dioxide and under the test conditions as indicated in Table 2. The migratory optical brightener was found to have severe migration.

Example 9

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 120% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene (LDPE), and 3) a lowermost layer with the same composition as the topmost layer was extrusion coated as a coextruded layer on to paper support at a total coverage of 26.0 g/m2 (27.9 microns). The ratio of layer thicknesses for Example 9 was 1:6:1.

Topmost "A" layer: 3% TiO2, 0.05% Hostalux® KS, etc in LDPE

Inner "B" layer: 12% TiO2, 0.05% Eastobrite® OB-1, etc in LDPE

Lowermost "A" 3% TiO2, 0.05% Hostalux® KS, etc in LDPE

Cellulose fiber paper

Example 10

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.22% Uvitex® OB in commercially available low density polyethylene, and 3) a lowermost layer with the same composition as the topmost layer was extrusion coated as a coextruded layer on to paper support at a total coverage of 25.2 g/m2 (27.0 microns). The ratio of layer thicknesses for Example 10 was 1:6:1.

Topmost "A" layer: 3% TiO2, 0.05% Hostalux® KS, etc in LDPE

Inner "B" layer: 12% TiO2, 0.22% Uvitex® OB, etc in LDPE

Lowermost "A" 3% TiO2, 0.05% Hostalux® KS, etc in LDPE

Cellulose fiber paper

Example 11

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Kayalight® O in commercially available low density polyethylene, and 3) a lowermost layer with the same composition as the topmost layer was extrusion coated as a coextruded layer on to paper support at a total coverage of 24.6 g/m2 (26.4 microns). The ratio of layer thicknesses for Example 11 was 1:6:1.

Topmost "A" layer: 3% TiO2, 0.05% Hostalux® KS, etc in LDPE

Inner "B" layer: 12% TiO2, 0.05% Kayalight® O, etc in LDPE

Lowermost "A" 3% TiO2, 0.05% Hostalux® KS, etc in LDPE

Cellulose fiber paper

TABLE 3

| SAMPLE | Layer ratio | A | B | A | Migration |
|---|---|---|---|---|---|
| 10 | 1:6:1 | Hostalux ® KS | 0.22% Uvitex ® | Hostalux ® KS | None |
| 11 | 1:6:1 | Hostalux ® KS | 0.05% Kayalight ® O | Hostalux ® KS | None |
| 9 | 1:6:1 | Hostalux ® KS | OB-1 | Hostalux ® KS | Moderate |

This variation showed that the migration of other migrating optical brightener to the surface is controlled by the presence of the present inventive mixture of Compounds A, B, and C, here, Hostalux® KS, in the upper layer.

Example 12

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene and 2) a lower layer containing 12% rutile TiO2, 0.06% phenolic antioxidant, 0.10% zinc stearate, 0.10% cobalt blue pigment, 0.003% quinacridone red pigment, and 0.05% Eastobrite® OB-1 optical brightener in commercially available low density polyethylene and 3) a lowermost layer with the same composition as the topmost layer was extrusion coated as a coextruded layer on to paper support at a total coverage of 38.8 g/m2 (41.6 microns).

Topmost "A" layer: 3% TiO2, 0.05% Hostalux® KS, etc in LDPE

Inner "B" layer: 12% TiO2, 0.05% Eastobrite® OB-1, etc in LDPE

Lowermost "A" 3% TiO2, 0.05% Hostalux® KS, etc in LDPE

Cellulose fiber paper

Layer thickness ratio (A:B:A) for Example 12 was 1:6:1.

TABLE 4

| SAMPLE | OB Layer thickness (microns) | A | B | A | Migration |
|---|---|---|---|---|---|
| 9 | 3.5:20.9:3.5 | Hostalux ® KS | OB-1 | Hostalux ® KS | Moderate |
| 12 | 5.2:31.2:5.2 | Hostalux ® KS | OB-1 | Hostalux ® KS | Severe |
| Monolayer-Example 8 | 25.2 | L02-071L 0.05% OB-1 | na | Na | Severe |

This variation showed severe migration with increasing thickness of the migrating optical brightener layer under the test conditions. At the highest thickness tested, multilayer migration performance was comparable to that of the unacceptable monolayer check of Example 8.

Example 13

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene and 2) a lower layer containing 12% rutile TiO2, 0.06% phenolic antioxidant, 0.10% zinc stearate, 0.10% cobalt blue pigment, 0.003% quinacridone red pigment, and 0.05% Eastobrite® OB-1 optical brightener in commercially available low density polyethylene and 3) a lowermost layer with the same composition as the topmost layer was extrusion coated as a coextruded layer on to paper support at a total coverage of 38.1 g/m2 (40.8 microns).

Topmost "A" layer: 3% TiO2, 0.05% Hostalux® KS, etc in LDPE

Inner "B" layer: 12% TiO2, 0.05% Eastobrite® OB-1, etc in LDPE

Lowermost "A" 3% TiO2, 0.05% Hostalux® KS, etc in LDPE

Cellulose fiber paper

Layer thickness ratio (A:B:A) for Example 13 was 1:3:1.

Example 14

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene and 2) a lower layer containing 12% rutile TiO2, 0.06% phenolic antioxidant, 0.10% zinc stearate, 0.10% cobalt blue pigment, 0.003% quinacridone red pigment, and 0.05% Eastobrite® OB-1 optical brightener in commercially available low density polyethylene and 3) a lowermost layer with the same composition as the topmost layer was extrusion coated as a coextruded layer on to paper support at a total coverage of 38.6 g/m2 (41.3 microns).

Topmost "A" layer: 3% TiO2, 0.05% Hostalux® KS, etc in LDPE

Inner "B" layer: 12% TiO2, 0.05% Eastobrite® OB-1, etc in LDPE

Lowermost "A" 3% TiO2, 0.05% Hostalux® KS, etc in LDPE

Cellulose fiber paper

Layer thickness ratio (A:B:A) for Example 14 was 1:9:1.

TABLE 5

| SAMPLE | Layer ratio | A | B | A | Migration |
|---|---|---|---|---|---|
| 13 | 1:3:1 | Hostalux ® KS | OB-1 | Hostalux ® KS | None |
| 9 | 1:6:1 | Hostalux ® KS | OB-1 | Hostalux ® KS | Moderate |
| 14 | 1:9:1 | Hostalux ® KS | OB-1 | Hostalux ® KS | Severe |
| Monolayer-Example 8 | na | L02-071L 0.05% OB-1 | na | Na | Severe |

This variation showed increasing migration with increasing thickness of the middle or "B" layer containing migrating optical brightener under the test conditions. At the highest ratio, 1:9:1, migration performance was comparable to that of the unacceptable monolayer check of Example 8.

Example 15

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene (PP) homopolymer of melt flow rate 30.0 g/10 min and 0.05% Eastobrite® OB-1 optical brightener in commercially available LDPE, and 3) a lowermost layer with the same composition as the topmost layer was extrusion coated as a coextruded layer on to paper support at a total coverage of 24.5 g/m2 (26.2 microns). The ratio of layer thicknesses for Example 15 was 1:6:1.

Topmost "A" layer: 3% TiO2, 0.05% Hostalux® KS, etc in LDPE

Inner "B" layer: 12% TiO2, 0.05% Eastobrite® OB-1, 10% PP, etc in LDPE

Lowermost "A" 3% TiO2, 0.05% Hostalux® KS, etc in LDPE

Cellulose fiber paper

Example 16

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.05% Eastobrite® OB-1 optical brightener in commercially available low density polyethylene, and 3) a lowermost layer with the same composition as the topmost layer was extrusion coated as a coextruded layer on to paper support at a total coverage of 37.0 g/m2 (39.6 microns). The ratio of layer thicknesses for Example 16 was 1:6:1.

Topmost "A" layer: 3% TiO2, 0.05% Hostalux® KS, etc in LDPE

Inner "B" layer: 12% TiO2, 0.05% Eastobrite® OB-1, 10% PP, etc in LDPE

Lowermost "A" 3% TiO2, 0.05% Hostalux® KS, etc in LDPE

Cellulose fiber paper

Example 17

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.05% Eastobrite® OB-1 optical brightener in commercially available low density polyethylene, and 3) a lowermost layer with the same composition as the topmost layer was extrusion coated as a coextruded layer on to paper support at a total coverage of 38.4 g/m2 (41.1 microns). The ratio of layer thicknesses for Example 17 was 1:3:1.

Topmost "A" layer: 3% TiO2, 0.05% Hostalux® KS, etc in LDPE

Inner "B" layer: 12% TiO2, 0.05% Eastobrite® OB-1, 10% PP, etc in LDPE

Lowermost "A" 3% TiO2, 0.05% Hostalux® KS, etc in LDPE

Cellulose fiber paper

Example 18

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.05% Eastobrite® OB-1 optical brightener in commercially available low density polyethylene, and 3) a lowermost layer with the same composition as the topmost layer was extrusion coated as a coextruded layer on to paper support at a total coverage of 38.2 g/m2 (40.9 microns). The ratio of layer thicknesses for Example 18 was 1:9:1.

Topmost "A" layer: 3% TiO2, 0.05% Hostalux® KS, etc in LDPE

Inner "B" layer: 12% TiO2, 0.05% Eastobrite®(D OB-1, 10% PP, etc in LDPE

Lowermost "A" 3% TiO2, 0.05% Hostalux® KS, etc in LDPE

Cellulose fiber paper

TABLE 6

| SAMPLE | OB Layer thickness | Layer ratio | A | B | A | Migration |
|---|---|---|---|---|---|---|
| 15 | 3.3:19.7:3.3 | 1:6:1 | Hostalux ® KS | OB-1 + 10% PP | Hostalux ® KS | None |
| 16 | 5.0:29.7:5.0 | 1:6:1 | Hostalux ® KS | OB-1 + 10% PP | Hostalux ® KS | None |
| 17 | 8.2:24.7:8.2 | 1:3:1 | Hostalux ® KS | OB-1 + 10% PP | Hostalux ® KS | None |
| 18 | 3.7:33.5:3.7 | 1:9:1 | Hostalux ® KS | OB-1 + 10% PP | Hostalux ® KS | None |
| Mono- | | NA | L02-071L | NA | NA | Severe |

TABLE 6-continued

| SAMPLE | OB Layer thickness | Layer ratio | A | B | A | Migration |
|---|---|---|---|---|---|---|
| layer-Example 8 | | | 0.05% OB-1 | | | |

This variation showed that the presence of polypropylene in the layer containing migrating optical brightener eliminated migration of the migratory optical brightener to the surface, regardless of layer thickness or ratio.

Example 19

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.22% Uvitex® OB optical brightener in commercially available low density polyethylene, and 3) a lowermost layer with the same composition as the topmost layer was extrusion coated as a coextruded layer on to paper support at a total coverage of 24.6 g/m2 (26.3 microns). The ratio of layer thicknesses for Example 19 was 1:6:1.

Topmost "A" layer: 3% TiO2, 0.05% Hostalux® KS, etc in LDPE

Inner "B" layer: 12% TiO2, 0.22% Uvitex® OB, 10% PP, etc in LDPE

Lowermost "A" 3% TiO2, 0.05% Hostalux® KS, etc in LDPE

Cellulose fiber paper

Example 20

A multilayer composition consisting of 1) a topmost layer containing 3% rutile TiO2, 0.03% phenolic antioxidant, 0.01% zinc stearate, and 0.05% Hostalux® KS optical brightener in commercially available low density polyethylene, 2) a lower layer containing 12% rutile TiO2, 0.06% phenolic antioxidant, 0.010% zinc stearate, 0.10% cobalt blue pigment, 0.0025% quinacridone red pigment, 10% commercially available polypropylene homopolymer of melt flow rate 30.0 g/10 min and 0.05% Kayalight® O optical brightener in commercially available low density polyethylene, and 3) a lowermost layer with the same composition as the topmost layer was extrusion coated as a coextruded layer on to paper support at a total coverage of 24.2 g/m2 (25.9 microns). The ratio of layer thicknesses for Example 20 was 1:6:1.

Topmost "A" layer: 3% TiO2, 0.05% Hostalux® KS, etc in LDPE

Inner "B" layer: 12% TiO2, 0.05% Kayalight® O, 10% PP, etc in LDPE

Lowermost "A" 3% TiO2, 0.05% Hostalux® KS, etc in LDPE

Cellulose fiber paper

TABLE 7

| SAMPLE | Migrating OB | A | B | A | Migration |
|---|---|---|---|---|---|
| 19 | 1:6:1 | Hostalux ® KS | 0.22% Uvitex ® + 10% PP | Hostalux ® KS | None |
| 20 | 1:6:1 | Hostalux ® KS | 0.05% Kayalight O ® + 10% PP | Hostalux ® KS | None |
| 15 | 1:6:1 | Hostalux ® KS | OB-1 + 10% PP | Hostalux ® KS | None |

This variation showed that the migration of other migrating optical brightener to the surface is controlled by the presence of polypropylene in the layer containing migrating optical brightener.

Example 21

A multilayer composition consisting of 1) a topmost layer containing 3% rutile TiO2, 0.03% phenolic antioxidant, 0.01% zinc stearate, 11% commercially available linear low density polyethylene (LLDPE) of melt index 20 and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene, and 3) a lowermost layer with the same composition as the topmost layer was extrusion coated as a coextruded layer on to paper support at a total coverage of 24.8 g/m2 (26.6 microns). The ratio of layer thicknesses for Example 21 was 1:6:1.

Topmost "A" layer: 3% TiO2, 0.05% Hostalux® KS, 11% LLDPE, etc in LDPE

Inner "B" layer: 12% TiO2, 0.05% Eastobrite® OB-1, 10% PP, etc in LDPE

Lowermost "A" 3% TiO2, 0.05% Hostalux® KS, 11% LLDPE, etc in LDPE

Cellulose fiber paper

Example 22

A multilayer composition consisting of 1) a topmost layer containing 3% rutile TiO2, 0.03% phenolic antioxidant, 0.01% zinc stearate, 11% commercially available linear low density polyethylene (LLDPE) of melt index 20 and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene, and 3) a lowermost layer with the same composition as the topmost layer was extrusion coated as a coextruded layer on to paper support at a total coverage of 37.2 g/m2 (39.8 microns). The ratio of layer thicknesses for Example 22 was 1:6:1.

Topmost "A" layer: 3% TiO2, 0.05% Hostalux® KS, 11% LLDPE, etc in LDPE

Inner "B" layer: 12% TiO2, 0.05% Eastobrite® OB-1, 10% PP, etc in LDPE

Lowermost "A" 3% TiO2, 0.05% Hostalux® KS, 11% LLDPE, etc in LDPE
Cellulose fiber paper Example 23

A multilayer composition consisting of 1) a topmost layer containing 3% rutile TiO2, 0.03% phenolic antioxidant, 0.01% zinc stearate, 11% commercially available linear low density polyethylene (LLDPE) of melt index 20 and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene, and 3) a lowermost layer with the same composition as the topmost layer was extrusion coated as a coextruded layer on to paper support at a total coverage of 38.2 g/m2 (40.9 microns). The ratio of layer thicknesses for Example 253 was 1:3:1.

Topmost "A" layer: 3% TiO2, 0.05% Hostalux® KS, 11% LLDPE, etc in LDPE
Inner "B" layer: 12% TiO2, 0.05% Eastobrite® OB-1, 10% PP, etc in LDPE
Lowermost "A" 3% TiO2, 0.05% Hostalux® KS, 11% LLDPE, etc in LDPE
Cellulose fiber paper Example 24

A multilayer composition consisting of 1) a topmost layer containing 3% rutile TiO2, 0.03% phenolic antioxidant, 0.01% zinc stearate, 11% commercially available linear low density polyethylene (LLDPE) of melt index 20 and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene, and 3) a lowermost layer with the same composition as the topmost layer was extrusion coated as a coextruded layer on to paper support at a total coverage of 38.1 g/m2 (40.8 microns). The ratio of layer thicknesses for Example 24 was 1:9:1.

Topmost "A" layer: 3% TiO2, 0.05% Hostalux® KS, 11% LLDPE, etc in LDPE
Inner "B" layer: 12% TiO2, 0.05% Eastobrite® OB-1, 10% PP, etc in LDPE
Lowermost "A" 3% TiO2, 0.05% Hostalux® KS, 11% LLDPE, etc in LDPE
Cellulose fiber paper

TABLE 8

| SAMPLE | Layer ratio | A | B | A | Migration |
|---|---|---|---|---|---|
| 21 | 1:6:1 | Hostalux ® KS + 11% LLDPE | OB-1 | Hostalux ® KS + 11% LLDPE | Moderate |
| 23 | 1:3:1 | Hostalux ® KS + 11% LLDPE | OB-1 | Hostalux ® KS + 11% LLDPE | None |
| 24 | 1:9:1 | Hostalux ® KS + 11% LLDPE | OB-1 | Hostalux ® KS + 11% LLDPE | Severe |

TABLE 8-continued

| SAMPLE | Layer ratio | A | B | A | Migration |
|---|---|---|---|---|---|
| Monolayer-Example 8 | Na | L02-071L 0.05% OB-1 | na | na | Severe |

This variation, utilizing linear low density polyethylene (LLDPE) instead of the low density polyethylene utilized in Table 5 above, showed similar results, that is, increasing migration with increasing thickness of the middle or "B" layer containing migrating optical brightener under the test conditions. At the highest ratio, 1:9:1, migration performance was comparable to that of the unacceptable monolayer check of Example 8.

Example 25

A multilayer composition consisting of 1) a topmost layer containing 3% rutile TiO2, 0.03% phenolic antioxidant, 0.01% zinc stearate, and 0.075% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene, and 3) a lowermost layer with the same composition as the topmost layer was extrusion coated as a coextruded layer on to paper support at a total coverage of 23.9 g/m2 (25.6 microns). The ratio of layer thicknesses for Example 25 was 1:6:1.

Topmost "A" layer: 3% TiO2, 0.075% Hostalux® KS, etc in LDPE
Inner "B" layer: 12% TiO2, 0.05% Eastobrite® OB-1, etc in LDPE
Lowermost "A" 3% TiO2, 0.075% Hostalux® KS, etc in LDPE
Cellulose fiber paper Example 26

A multilayer composition consisting of 1) a topmost layer containing 3% rutile TiO2, 0.03% phenolic antioxidant, 0.01% zinc stearate, and 0.075% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.05% Eastobrite® OB-1 optical brightener in commercially available low density polyethylene, and 3) a lowermost layer with the same composition as the topmost layer was extrusion coated as a coextruded layer on to paper support at a total coverage of 24.1 g/m2 (25.8 microns). The ratio of layer thicknesses for Example 26 was 1:6:1.

Topmost "A" layer: 3% TiO2, 0.075% Hostalux® KS, etc in LDPE
Inner "B" layer: 12% TiO2, 0.05% Eastobrite® OB-1, 11% PP, etc in LDPE
Lowermost "A" 3% TiO2, 0.075% Hostalux® KS, etc in LDPE
Cellulose fiber paper Example 27

A multilayer composition consisting of 1) a topmost layer containing 3% rutile TiO2, 0.03% phenolic antioxidant, 0.01% zinc stearate, 11% commercially available linear low density polyethylene (LLDPE) of melt index 20, and 0.075% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, and 0.05% Eastobrite® OB-1 optical brightener in commercially available low density polyethylene, and 3) a lowermost layer with the same composition as the topmost layer was extrusion coated as a coextruded layer on to paper support at a total coverage of 24.2 g/m2 (25.9 microns). The ratio of layer thicknesses for Example 27 was 1:6:1.

Topmost "A" layer: 3% TiO2, 0.075% Hostalux® KS, 1% LLDPE etc in LDPE

Inner "B" layer: 12% TiO2, 0.05% Eastobrite® OB-1, etc in LDPE

Lowermost "A" 3% TiO2, 0.075% Hostalux® KS, 11% LLDPE etc in LDPE

Cellulose fiber paper

Example 28

A multilayer composition consisting of 1) a topmost layer containing 3% rutile TiO2, 0.03% phenolic antioxidant, 0.01% zinc stearate, 1% commercially available linear low density polyethylene (LLDPE) of melt index 20, and 0.075% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.05% Eastobrite® OB-1 optical brightener in commercially available low density polyethylene, and 3) a lowermost layer with the same composition as the topmost layer was extrusion coated as a coextruded layer on to paper support at a total coverage of 23.8 g/m2 (25.5 microns). The ratio of layer thicknesses for Example 28 was 1:6:1.

Topmost "A" layer: 3% TiO2, 0.075% Hostalux® KS, 11% LLDPE etc in LDPE

Inner "B" layer: 12% TiO2, 0.05% Eastobrite® OB-1, 10% PP etc in LDPE

Lowermost "A" 3% TiO2, 0.075% Hostalux® KS, 11% LLDPE etc in LDPE

Cellulose fiber paper

TABLE 9

| SAMPLE | Layer ratio | A | B | A | Migration |
|---|---|---|---|---|---|
| 25 | 1:6:1 | 0.075% Hostalux ® KS | 0.05% OB-1 | 0.075% Hostalux ® KS | None |
| 26 | 1:6:1 | 0.075% Hostalux ® KS | 0.05% OB-1 | 0.075% Hostalux ® KS | None |
| 27 | 1:6:1 | 0.075% Hostalux ® KS + 11% LLDPE | 0.05% OB-1 | 0.075% Hostalux ® KS + 11% LLDPE | Slight |

TABLE 9-continued

| SAMPLE | Layer ratio | A | B | A | Migration |
|---|---|---|---|---|---|
| 28 | 1:6:1 | 0.075% Hostalux ® KS + 11% LLDPE | 0.05% OB-1 | 0.075% Hostalux ® KS + 11% LLDPE | None |

This variation shows that weight % loading of non-migratory optical brightener in the top layer may be varied, here, increased, and migration is still improved over a monolayer.

Example 29

A multilayer composition consisting of 1) a topmost layer containing 3% rutile TiO2, 0.03% phenolic antioxidant, 0.01% zinc stearate, 11% commercially available linear low density polyethylene (LLDPE) of melt index 20 and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.22% Uvitex® OB optical brightener in commercially available low density polyethylene, and 3) a lowermost layer with the same composition as the topmost layer was extrusion coated as a coextruded layer on to paper support at a total coverage of 23.9 g/m2 (25.6 microns). The ratio of layer thicknesses for Example 29 was 1:6:1.

Topmost "A" layer: 3% TiO2, 0.05% Hostalux® KS, 11% LLDPE etc in LDPE

Inner "B" layer: 12% TiO2, 0.22% Uvitex® OB, 10% PP, etc in LDPE

Lowermost "A" 3% TiO2, 0.05% Hostalux® KS, 11% LLDPE etc in LDPE

Cellulose fiber paper

Example 30

A multilayer composition consisting of 1) a topmost layer containing 3% rutile TiO2, 0.03% phenolic antioxidant, 0.01% zinc stearate, 1% commercially available linear low density polyethylene (LLDPE) of melt index 20 and 0.05% Hostalux® KS optical brightener in commercially available low density polyethylene, 2) a lower layer containing 12% rutile TiO2, 0.06% phenolic antioxidant, 0.10% zinc stearate, 0.10% cobalt blue pigment, 0.0025% quinacridone red pigment, 10% commercially available polypropylene homopolymer of melt flow rate 30.0 g/10 min and 0.05% Kayalight® O optical brightener in commercially available low density polyethylene, and 3) a lowermost layer with the same composition as the topmost layer was extrusion coated as a coextruded layer on to paper support at a total coverage of 24.2 g/m2 (25.9 microns). The ratio of layer thicknesses for Example 30 was 1:6:1.

Topmost "A" layer: 3% TiO2, 0.05% Hostalux® KS, 11% LLDPE etc in LDPE

Inner "B" layer: 12% TiO2, 0.05% Kayalight® O, 10% PP, etc in LDPE

Lowermost "A" 3% TiO2, 0.05% Hostalux® KS, 11% LLDPE etc in LDPE
Cellulose fiber paper

TABLE 10

| SAMPLE | Layer ratio | A | B | A | Migration |
|---|---|---|---|---|---|
| 29 | 1:6:1 | Hostalux ® KS + 11% LLDPE | 0.22% Uvitex ® + 10% PP | Hostalux ® KS + 11% LLDPE | None |
| 30 | 1:6:1 | Hostalux ® KS + 11% LLDPE | 0.05% Kayalight O ® + 10% PP | Hostalux ® KS + 11% LLDPE | None |
| 26 | 1:6:1 | 0.075% Hostalux ® KS | 0.05% OB-1 | 0.075% Hostalux ® KS | None |

This variation showed that the migration of other migrating optical brightener to the surface is controlled by the presence behavior of the present inventive mixture of Compounds A, B, and C, here, Hostalux® KS, in the upper layer.

In Examples 31–34, the optical brightener was compounded separately as a concentrate in low density polyethylene or low density polyethyene in combination with polypropylene. This concentrate was then blended with another concentrate containing the TiO2 and all other additives and additional LDPE, and the resulting blend was extrusion coated.

Example 31

A sequentially coated multilayer composition was evaluated. A lowermost layer consisting of 12.5% anatase TiO2, 0.1% phenolic antioxidant, 0.5% calcium stearate, and 0.05% Hostalux® KS optical brightener in commercially available low density polyethylene was extrusion coated onto cellulose fiber paper at a coverage of 13.0 g/m2 (13.3 microns) and then was extrusion coated in a second pass with an upper layer consisting of 12.5% anatase TiO2, 0.1% phenolic antioxidant, 0.5% calcium stearate, and 0.05% Hostalux® KS optical brightener in commercially available low density polyethylene at a coverage of 12.6 g/m2 (12.9 microns) (the upper and lower layers were the same composition in this example) to simulate a coextruded layer on to paper support. The ratio of layer thicknesses for Example 31 was 1:1.

Topmost "A" layer: 12.5% TiO2, 0.05% Hostalux® KS, etc in LDPE
Lowermost "B" layer: 12.5% TiO2, 0.05% Hostalux® KS, etc in LDPE
Cellulose fiber paper Example 32

A sequentially coated multilayer composition was evaluated. A lowermost layer consisting of 12.5% anatase TiO2, 0.1% phenolic antioxidant, 0.5% calcium stearate, and 0.05% Eastobrite® OB-1 optical brightener in commercially available low density polyethylene was extrusion coated onto cellulose fiber paper at a coverage of 12.6 g/m2 (12.8 microns) and then was extrusion coated in a second pass with an upper layer consisting of 12.5% anatase TiO2, 0.1% phenolic antioxidant, 0.5% calcium stearate, and 0.05% Hostalux® KS optical brightener in commercially available low density polyethylene at a coverage of 12.8 g/m2 (13.1 microns) to simulate a coextruded layer on to paper support. The ratio of layer thicknesses for Example 32 was 1:1.

Topmost "A" layer: 12.5% TiO2, 0.05% Hostalux® KS, etc in LDPE
Lowermost "B" layer: 12.5% TiO2, 0.05% Eastobrite® OB-1, etc in LDPE
Cellulose fiber paper Example 33

A sequentially coated multilayer composition was evaluated. A lowermost layer consisting of 12.5% anatase TiO2, 0.1% phenolic antioxidant, 0.5% calcium stearate, 10% commercially available polypropylene homopolymer of melt flow rate 30.0 g/10 min, and 0.05% Eastobrite® OB-1 optical brightener in commercially available low density polyethylene was extrusion coated onto cellulose fiber paper at a coverage of 13.1 g/m2 (13.4 microns) and then was extrusion coated in a second pass with an upper layer consisting of 12.5% anatase TiO2, 0.1% phenolic antioxidant, 0.5% calcium stearate, and 0.05% Hostalux® KS optical brightener in commercially available low density polyethylene at a coverage of 111.8 g/m2 (12.1 microns) to simulate a coextruded layer on to paper support. The ratio of layer thicknesses for Example 33 was 1:1.

Topmost "A" layer: 12.5% TiO2, 0.05% Hostalux® KS, etc in LDPE
Lowermost "B" layer: 12.5% TiO2, 0.05% Eastobrite® OB-1, 10% PP etc in LDPE
Cellulose fiber paper Example 34

A sequentially coated multilayer composition was evaluated. A lowermost layer consisting of 12.5% anatase TiO2, 0.1% phenolic antioxidant, 0.5% calcium stearate, 5% commercially available polypropylene homopolymer of melt flow rate 30.0 g/10 min, and 0.05% Eastobrite® OB-1 optical brightener in commercially available low density polyethylene was extrusion coated onto cellulose fiber paper at a coverage of 12.3 g/m2 (12.6 microns) and then was extrusion coated in a second pass with an upper layer consisting of 12.5% anatase TiO2, 0.1% phenolic antioxidant, 0.5% calcium stearate, and 0.05% Hostalux® KS optical brightener in commercially available low density polyethylene at a coverage of 12.6 g/m2 (12.8 microns) to simulate a coextruded layer on to paper support. The ratio of layer thicknesses for Example 34 was 1:1.

Topmost "A" layer: 12.5% TiO2, 0.05% Hostalux® KS, etc in LDPE
Lowermost "B" layer: 12.5% TiO2, 0.05% Eastobrite® OB-1,5% PP etc in LDPE
Cellulose fiber paper Example 35

A monolayer composition was evaluated. The monolayer consisted of 12.5% anatase TiO2, 0.1% phenolic antioxidant, 0.5% calcium stearate, and 0.05% Eastobrite® OB-1 optical brightener in commercially available low density polyethylene was extrusion coated onto cellulose fiber paper at a coverage of 25.3 g/m2 (25.9 microns). Migration of the optical brightener was moderate.

TABLE 11

| Sample | Layer Ratio | A | B | Migration |
|---|---|---|---|---|
| 31 | 1:1 | 0.05% Hostalux ® KS | 0.05% Hostalux ® KS | None |

TABLE 11-continued

| Sample | Layer Ratio | A | B | Migration |
|---|---|---|---|---|
| 32 | 1:1 | 0.05% Hostalux ® KS | 0.05% Eastobrite ® OB-1 | None |
| 33 | 1:1 | 0.05% Hostalux ® KS | 0.05% Eastobrite ® OB-1 + 10% PP | None |
| 34 | 1:1 | 0.05% Hostalux ® KS | 0.05% Eastobrite ® OB-1 + 5% PP | None |
| 35 | na | 0.05% Eastobrite ® OB-1 | na | Moderate |

This variation shows the reduction in migration when a layer containing a non-migrating optical brightener is coated sequentially over a layer containing a migrating brightener.

The invention has been described in detail with particular reference to certain preferred embodiments thereof, but it will be understood that variations and modifications may be effected within the spirit and scope of the invention.

What is claimed is:

1. An imaging element comprising an imaging layer and a support, wherein said support comprises a base material having thereon at least two polyolefin layers, wherein the uppermost layer of said at least two polyolefin layers comprises a non-migratory mixture of optical brighteners, said non-migratory mixture of optical brighteners comprising a Compound A having the following formula:

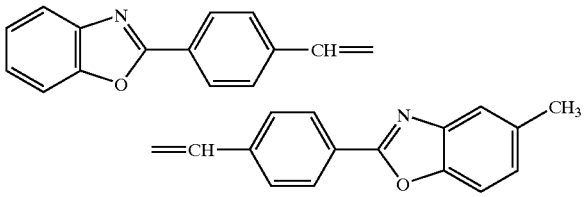

a Compound B having the following formula:

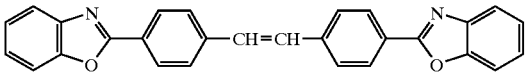

and a Compound C having the following formula:

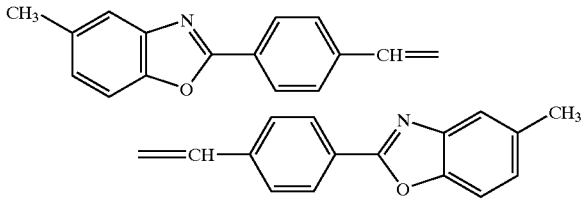

wherein at least one layer below said uppermost layer of said at least two polyolefin layers comprises migratory optical brightener; and wherein said imaging layer is on the same side of said base material as said at least two polyolefin layers.

2. The imaging element of claim 1 wherein said imaging element has reduced exudation of the migratory optical brightener at the polyolefin surface.

3. The imaging element of claim 1 wherein said at least two polyolefin layers comprise coextruded layers.

4. The imaging element of claim 1 wherein said at least two polyolefin layers comprise sequentially extruded layers.

5. The imaging element of claim 1 wherein said non-migratory mixture of optical brighteners comprises from 15 to 90% by weight based on the total weight of said mixture of Compound A; from 5 to 70% by weight based on the total weight of said mixture of Compound B; and from 5 to 70% by weight based on the total weight of said mixture of Compound C.

6. The element of claim 1 wherein said non-migratory brightener mixture comprises by weight based on the total weight of said mixture from 40 to 70% of Compound A, from 10 to 35% of Compound B, and from 10 to 35% of Compound C.

7. The imaging element of claim 1 wherein said non-migratory mixture is present in an amount of from 0.001 to 0.25% weight based on the total weight of said uppermost polyolefin layer.

8. The element of claim 1 wherein said non-migratory brightener mixture is present in an amount of from 0.01 to 0.10% by weight based on the total weight of said uppermost polyolefin coating.

9. The element of claim 1 wherein at least one of said at least two polyolefin layers is polypropylene.

10. The element of claim 1 wherein at least one of said at least two polyolefin layers is polyethylene.

11. The element of claim 10 wherein at least one of said at least two polyolefin layers is linear low density polyethylene.

12. The element of claim 1 wherein said base material comprises paper.

13. The element of claim 12 wherein said base material further comprises a polyolefin sheet.

14. The element of claim 13 wherein said polyolefin sheet comprises an oriented polypropylene sheet.

15. The element of claim 1 wherein said base material comprises synthetic paper.

16. The element of claim 15 wherein said synthetic paper comprises a closed cell foam core sheet.

17. The element of claim 16 further comprising an upper and lower stiffening flange sheet adhered to said closed cell foam core sheet.

18. The element of claim 1 wherein said migratory optical brightener comprises at least one compound of Formula I:

Formula I

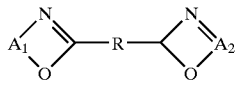

wherein:

R is a bivalent 4,4'-stilbene radical; and $A_1$ and $A_2$ is each an o-phenylene radical.

19. The element of claim 1 wherein said migratory optical brighteners comprise at least one member selected from the group consisting of brightener (2,5-(di-5-tert-butylbenzoyl) thiophenate, (2,2-(1,2-ethendiyldi-4,1-phenylene) bisbenzoxazole, 2-[4-[2-[4-(2-benzoxazolyl)phenyl] ethenyl]phenyl]-5-methylbenzoxazole, 2,2'-(1,2-ethenediyldi-4,1-phenylene)bis-5-methylbenzoxazole, 2-[4-[2-[4-(2-benzoxazolyl)phenyl]ethenyl]phenyl]-5-dimethyl benzoxazole, or migratory combinations thereof.

20. The element of claim 1 wherein said migratory optical brightener comprises 2,2'-(1,2-ethenediyldi-4,1-phenylene) bisbenzoxazole.

21. The element of claim 1 wherein said imaging layer comprises a photosensitive silver halide imaging layer.

22. The element of claim 1 wherein said imaging layer comprises an inkjet receiving layer.

23. The element of claim 1 wherein said imaging layer comprises a thermal dye receiving layer.

24. The element of claim 1 wherein said imaging layer comprises an electrophotographic imaging layer.

25. The imaging element of claim 1 wherein said at least two polyolefin layers further comprise white pigment.

26. The imaging element of claim 25 wherein said white pigment comprises titanium dioxide.

27. The imaging element of claim 25 wherein said white pigment is present in an amount of 5 to 25% by weight based on the total weight of the polyolefin layer.

28. The element of claim 1 wherein said at least two polyolefin layers further comprises filler materials.

29. The element of claim 28 wherein said filler materials comprise stiffening agent.

30. The element of claim 28 wherein said filler material comprises at least one member selected from the group consisting of zinc oxide, talc or calcium carbonate.

31. The element of claim 1 wherein said support further comprises a clear polyethylene coating on the side of said base material opposite to said at least two polyolefin layers.

32. The element of claim 1 wherein said at least one layer below said uppermost layer of said at least two polyolefin layers further comprises polypropylene.

33. The element of claim 1 wherein said at least one layer below said uppermost layer of said at least two polyolefin layers further comprises polyolefin and polypropylene.

34. The element of claim 1 wherein said at least one layer below said uppermost layer of said at least two polyolefin layers further comprises at least 5 weight percent polypropylene.

35. The element of claim 1 wherein said at least two polyolefin layers comprise an uppermost layer, a lowermost layer, and an inner layer therebetween.

36. The element of claim 35 wherein said uppermost layer and said lowermost layer comprise the same composition.

37. The element of claim 35 wherein said inner layer comprises polypropylene, alone or in combination with another polyolefin.

* * * * *